US005361826A

United States Patent [19]

Yamauchi et al.

[11] Patent Number: 5,361,826

[45] Date of Patent: Nov. 8, 1994

[54] LAMINAR FLOW INJECTION MOLDING APPARATUS AND LAMINAR FLOW INJECTION MOLDING METHOD

[75] Inventors: Noriyoshi Yamauchi; Hitoshi Ishida, both of Fuchu; Hirotake Usui, Tokyo; Yoshiaki Egoshi, Fuchu, all of Japan

[73] Assignee: Ryobi Ltd., Hiroshima, Japan

[21] Appl. No.: 34,377

[22] Filed: Mar. 4, 1993

[30] Foreign Application Priority Data

Mar. 13, 1992 [JP] Japan ..... 4-089651

[51] Int. Cl.[5] ..... B22D 17/32; B22D 17/14

[52] U.S. Cl. ..... 164/457; 164/113; 164/155.1; 164/312

[58] Field of Search ..... 164/457, 113, 312, 155

[56] References Cited

FOREIGN PATENT DOCUMENTS 0475645 3/1992 European Pat. Off. .
56-109154 8/1981 Japan .
59-215259 12/1984 Japan .
62-034659 2/1987 Japan .
2-084239 3/1990 Japan .

*Primary Examiner*—Kuang Y. Lin

*Attorney, Agent, or Firm*—Sughrue, Mion, Zinn, Macpeak & Seas

[57] ABSTRACT

A laminar flow injection molding apparatus and a laminar flow injection molding method capable of directly judging flow mode of molten metal flowing into a metal mold, either laminar flow mode or turbulent flow mode. An injection molding apparatus includes metal molds in which a runner portion, a cavity, and a gas vent passage are formed in communication with a casting sleeve. Molten metal detection members are provided in confrontation with at least one of the runner portion, the cavity and the gas vent passage. In a single injecting operation, molten metal detection signal is generated each time the molten metal is brought into contact with the detection member. The molten metal detection member is connected to a counter circuit where numbers of the detection signals are stored as a count value. A judgment circuit to which a preset value is inputted is electrically connected to the counter circuit so as to compare the count value with the preset value. Since flow mode of the molten metal can be directly detected, quality of the casted product can be determined even during the casting process, to thereby enhance productivity.

13 Claims, 2 Drawing Sheets

LAMINAR FLOW INJECTION MOLDING APPARATUS AND LAMINAR FLOW INJECTION MOLDING METHOD

BACKGROUND OF THE INVENTION

The present invention relates to a laminar flow injection molding apparatus and a laminar flow injection molding method. More particularly, the invention relates to such apparatus and method in which casting operation continues as long as molten metal flows in a laminar flow, and turbulent flow can be promptly converted into a laminar flow.

Quality of a casted product produced by an injection molding apparatus, particularly a die-casting machine, is largely dependent on fluidity of the molten metal which is an injected material. For example, if molten metal is turbulently introduced into the cavity, the molten metal flows discontinuously, i.e. , does not fill the cavity at a steady rate. As a result, the molten metal cannot be sufficiently distributed throughout the cavity, since air may be trapped or involved into the molten metal . Consequently, the casted product may not have a uniform mechanical strength over its mass, and may not have sufficient pressure resistance, Introducing molten metal into the cavity at a continuous laminar flow is therefore necessary. Such factors as injection speed, injection pressure, and variation in injection speed requires careful consideration to obtain the laminar flow. However, determining the fluidity of the molten metal flowing into the cavity is generally difficult.

In order to determine casting conditions required for improving fluidity, Japanese Patent Application Kokai No. sho-56-109154 discloses a die-casting machine. According to the invention, several injection operations are carried out in which the injection plunger is stopped at a different position during each injection operation-The metal mold is opened after the injected molten metal cools and solidifies, and quality in the casted products derived from each stop position is checked to determine fluidity of the molten metal and thus optimum injecting condition.

However, with the invention described in the Japanese Patent Application Kokai No. sho-56-109154, inertial force is imparted on the molten metal depending on the injection speed. Therefore, even if the injection plunger is temporarily stopped during the injection, it is almost difficult to conclude that the molten metal is also stopped at that position. Thus, accurate judgment cannot be made. Further, the molten metal flow can only be indirectly inspected by examining resultant products after casting. Directly observing actual flow to judge whether laminar flow or turbulent flow would be impossible.

Japanese Patent Application Kokai No. sho-59-215259 discloses necessity of high speed injection so as to avoid reduction in temperature of the molten metal, and discloses shifting the injection speed from high speed to low speed immediately before the molten metal enters the cavity to avoid scattering and turbulence of the molten metal, and consequent air involvement, that accompanies high speed injection.

In the invention disclosed in the Japanese Patent Application Kokai No. sho 59-215259, primary attention is directed to the prevention of the molten metal from its turbulent flowing during low speed injection. The disclosed invention does not provide a method for directly determining whether the molten metal has laminar flow or turbulent flow at the time of low speed injection.

SUMMARY OF THE INVENTION

Thus, it is an object of the present invention to provide a laminar flow injection molding apparatus and a method therefor in which flow of an injected molten metal can be directly judged, and casting operation can be continued as far as the molten metal maintains laminar flow, and flow can be promptly corrected to laminar flow if the molten metal flows turbulently.

In order to attain these and other objects, the present invention provides a laminar flow injection molding apparatus including a casting sleeve, a pair of metal molds, an injection plunger, an injection cylinder, a cylinder drive means, a molten metal detection means, a counting means, a judging means, and control means. The pair of metal molds forms therein a runner portion in communication with the casting sleeve, a cavity and a gas vent passage. The injection plunger is slidably disposed within the casting sleeve for urging a molten metal into the cavity. The injection cylinder is connected to the injection plunger for reciprocally moving the injection plunger. The cylinder drive means is adapted for driving the injection cylinder. The molten metal detection means is disposed at least one of the runner portion, the cavity and the gas vent passage for generating a molten metal detection signal each time the molten metal contacts the detection means in single injection. The counting means is electrically connected to the molten metal detection means for counting number of the molten metal detection signals as a count value and for storing the count value. The judging means is electrically connected to the counting means. A present value is storable into the judging means for comparing the present value with the count value. The control means is electrically connected to the counting means, the judging means and the cylinder driving means for controlling a driving operation of the cylinder drive means if the count value is not less than the preset value and for resetting the counting means in response to a start of the injection.

The present invention further provides a laminar flow injection molding method including the steps of (a) disposing a molten metal detection means at least at one of a runner portion, a cavity and a gas vent passage, (b) inputting a preset value into a judging means, the preset value being indicative of a turbulent flow of a molten metal, (c) resetting a counting means in response to a start of an injection, (d) detecting the molten metal and generating a molten metal detection signal each time the molten metal contacts the molten metal detection means during single injection, (e) storing number of the molten metal detection signals as a count value into a counting means, and (f) comparing the count value with the present value for a judgment of a flowing mode of the metal mold as the turbulent flow if the count value is not less than the preset value.

A preset value is beforehand inputted into the judging means. For example, input of the preset value of "2" implies discontinuous flow of the molten metal, i.e., turbulent flow. If the injection is started, the counting means undergoes resetting to provide a countable state. The molten metal detection means detects the injected molten metal in such a manner that a molten metal detection signal is generated each time the molten metal contacts the molten metal detection means in single injection. Number of the detection signals are counted by the counting means and are stored. Comparison between the counted value and the preset value is made in the judging means to determine which one is greater than the other. Provided that the count value is "3", discontinuous flows occurs at thrice, which is greater than "2", and therefore, the molten metal flow mode is judged to be the turbulent flow.

DETAILED DESCRIPTION OF THE PREFERRED EMBODIMENTS

Figure 1:
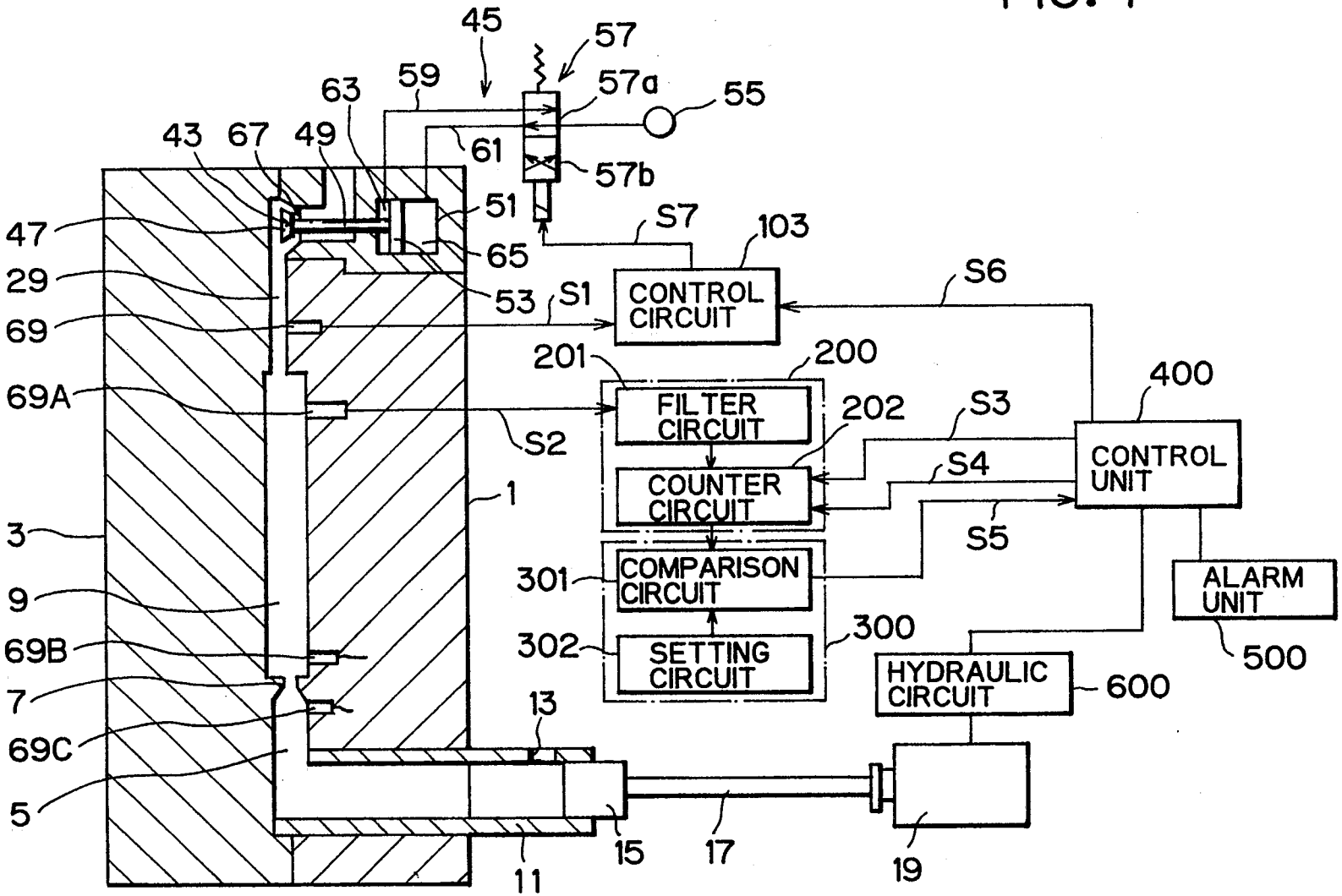
FIG. 1 is a schematic view showing an overall arrangement of a laminar flow injection molding apparatus applied to a die-casting machine according to one embodiment of the present invention.

A laminar flow die-casting injection machine and a method for injecting molten metal in a laminar flow according to one embodiment of this invention will be described with reference to FIG. 1. The die-casting machine includes a stationary metal mold 1 and a movable metal mold 3. Between these molds 1 and 3, a runner 5 is formed whose upper end is connected to a cavity 9 through a gate 7. Further, a gas vent passage 29 is formed which is in communication with the cavity at its upper end. One end of the gas vent passage 29 is in communication with the atmosphere.

In a lower portion of the stationary metal mold 1, is provided a casting sleeve 11 in communication with the runner 5. A casting port 13 is formed at a right side of the casting sleeve 11 in the drawing, through which a molten metal is poured into the sleeve 11.

An injection plunger 15 is slidably disposed in rightward/leftward direction in the drawings within the casting sleeve 11. The injection plunger 15 is connected to an injection cylinder 19 through a plunger rod 17. The injection plunger 15 is slidingly moved within the casting sleeve 11 by driving the injection cylinder 19 which is driven by a hydraulic circuit 600. Opening degree of a valve of the injection cylinder 19 is controlled by the hydraulic circuit 600 so as to control the speed at which the injection plunger 15 moves.

A gas vent valve 43 having a valve body 47 and a valve stem 49 connected to a piston 53 slidably disposed in a cylinder 51 is disposed at the end of the gas vent passage 29 opposing the cavity 9. The gas vent valve 43 is driven by a valve driving mechanism 45 provided with a compressor 55. The compressor 55 supplies compressed air into a front chamber 63 or a rear chamber 65 of the cylinder 51 through an electromagnetic change-over valve 57, and a pipe 59 or a pipe 61. Accordingly, the piston 53 moves rightwardly or leftwardly in the drawing, consequently urging the valve body 47 toward and away from a seat 67 to close or open the valve. The electromagnetic change-over valve 57 is movable to change-over positions 57*a* and 57*b*. Compressed air is selectively introduced into the front chamber 63 or the rear chamber 65 upon change-over operation of the changeover valve 57.

A first detection member 69 is disposed in the gas vent passage 29. The first detection member 69 detects the molten metal rising therein as urged by the plunger 15. By virtue of a control circuit 103 constituted by an electronic circuit such as a relay circuit, a switching circuit, a flip-flop circuit, or a monostable multivibrator, the electromagnetic change-over valve 57 is turned ON or OFF to open or close the gas vent valve 32. The first detection member 69 is connected to the control circuit 103 which is connected to the valve driving mechanism 45. A first or initial molten metal detection signal S1 is outputted from the first detection member 69 to the control circuit 103 for driving the valve driving mechanism 45 to close the gas vent valve 43.

A second molten metal detection member 69A is disposed within the cavity 9. The second molten metal detection member 69A is connected to a counting circuit 200 described later. When the molten metal reaches the second detection member 69A, the second detection member 69A detects the molten metal and outputs a detection signal S2 to the counting circuit 200. If the molten metal is turbulently and discontinuously introduced into the cavity 9, it will temporarily draw away from the second detection member 69A after initially reaching the second detection member 69A. As the molten metal continues to be introduced into the cavity 9, the molten metal will again contact the second detection member 69A. This action may be repeated several times depending on turbulence of the molten metal. Each separate time the molten metal contacts the second detection member 69A, the second detection member 69A outputs a signal to the counting circuit 200. Detection times are stored in the counting circuit 200.

The counting circuit 200 includes a filter circuit 201 and a counter circuit 202 for counting the times of the detections (pulse numbers) detected by the second detection member 69A. The filter circuit 201 is electrically connected to the second detection member 69A so as to allow the molten metal detection signals to pass therethrough but shut off noise. The counter circuit 202 is connected to the filter circuit 201 for counting and storing the pulse numbers passing through the filter circuit 201.

The counting circuit 200 is connected to a judgment circuit 300 which. The judgment circuit 300 includes a comparison circuit 301 connected to the counter circuit 202 and a setting circuit 302 connected to the comparison circuit 301. The setting circuit 302 is adapted for setting a predetermined pulse number (for example, N=2) which is indicative of the turbulent flow of the molten metal. That is, if the molten metal flows into the cavity 9 in a laminar flow, the second detection member 69A detects the molten metal only once, since the molten metal is continuously supplied into the cavity. On the other hand, if the molten metal turbulently flows into the cavity, the molten metal repeatedly contacts and withdraws from the second detection member 69A since the molten metal is discontinuously supplied. At each contact, a pulse is generated and is counted in the counter circuit 202. Thus, the number of pulses deemed critical to good laminar flow are beforehand stored in the setting circuit 302. The preset value in the setting circuit 302 and a count value from the counter circuit 202 are both input into the comparison circuit 301. These are compared to determine whether or not the molten metal has turbulent flow.

The counter circuit 202 is connected to a control unit 400 of the casting machine. At injection start, a count start signal S3 is transmitted from the control unit 400 to the counter circuit 202, and further, at start and finish of injection, a counter reset signal is transmitted from the control unit 400 to the counter circuit 202 in response to a signal such as a signal transmitted when the mold is open.

The comparison circuit 301 is also connected to the control unit 400, and the injection cylinder 19 is connected to the control unit 400 through the hydraulic circuit 600. If the comparison circuit 301 determines there is turbulent flow, it transmits an alarm signal S5 to the control unit 400 so that an alarm unit 500 connected to the control unit 400 generates an alarm. The alarm warns an operator that flow is turbulent, so the operator can re-adjust the degree to which the hydraulic circuit 600 opens the valve to lower the speed of the injection plunger for providing injection with laminar flow. The control circuit 103 is connected to the control unit 400. At the start of injection, a gas vent valve control start signal S6 is transmitted from the control unit 400 to the control circuit 103.

Figure 2:
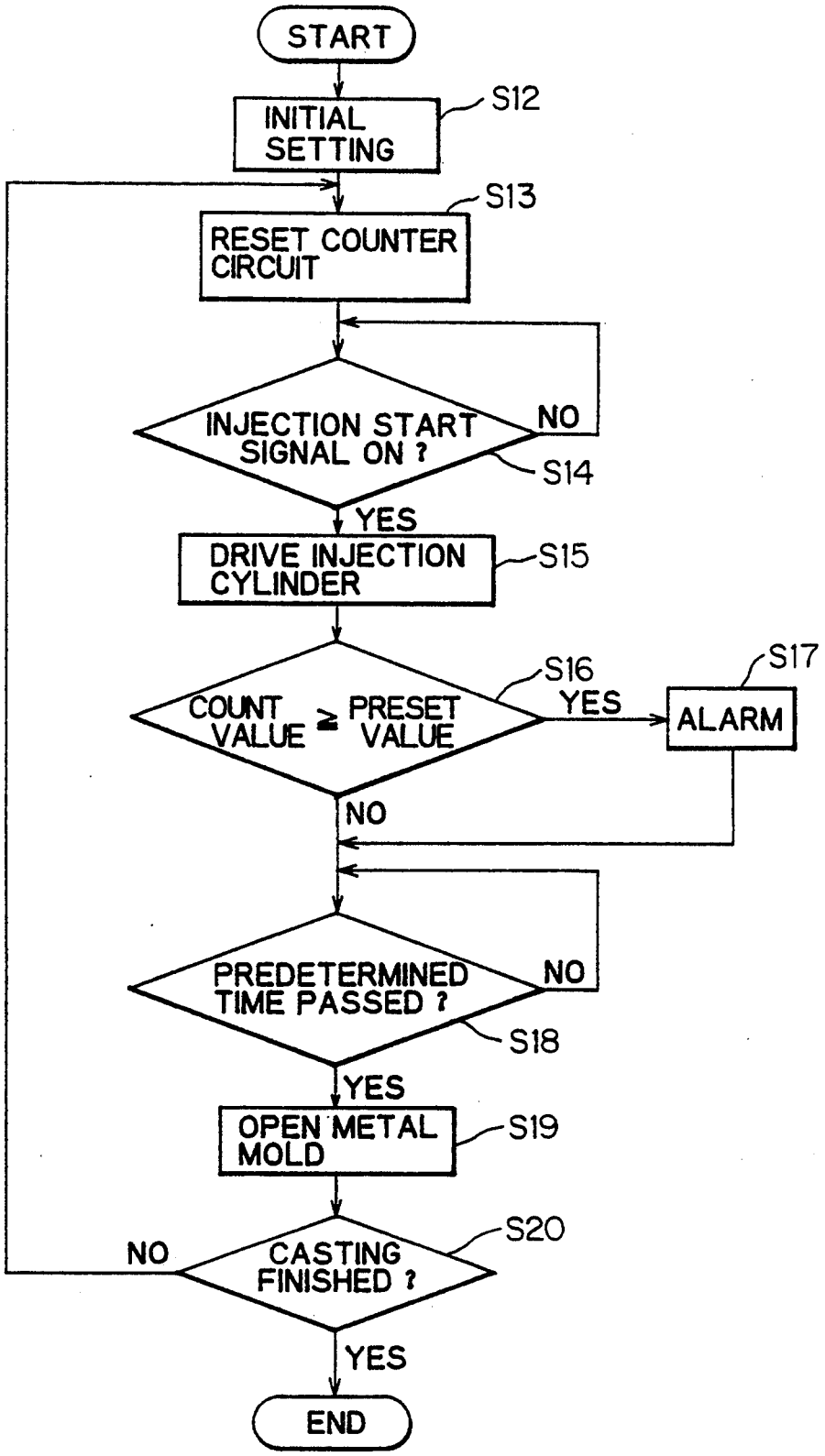
FIG. 2 is a flowchart for description of an operation of a control system in the laminar flow injection molding apparatus according to the embodiment.

Operation in the above described construction will next be described with reference to the flowchart shown in FIG. 2. First, upon implementing power supply to start operation of the control unit 400, an initial settings are made in step S12 where a preset value (for example, N=2) is input into the setting circuit 302, a count start signal S3 is transmitted to the counter circuit 202, the control circuit 103 is rendered operative, and the degree at which the hydraulic circuit 600 opens the valve is adjusted to provide laminar flow injection. Then, in Step S13, a counter reset signal S4 is transmitted to reset the count value in the counter circuit 202 to zero.

Next, in Step S14, whether or not the injection start signal is transmitted is determined. That is, while the gas vent valve 43 is open, the molten metal is poured into the casting sleeve 11 through the casting port 13, and thereafter, in response to the injection start signal, in Step S15 the hydraulic circuit 600 is operated to drive the injection cylinder 19 for slidingly moving the plunger 15 in the leftward direction in the drawing. This sliding movement of the plunger 15 closes the casting port 13, and the molten metal flows into the cavity 9 through the runner 5 and the gate 7.

If the molten metal reaches the cavity 9 and contacts the second detection member 69A, the second detection member 69A generates the detection signal S2, which is transmitted to and stored into the counter circuit 202 through the filter circuit 200. That is, if the molten metal has the laminar flow, it flows smoothly and is continuously into the cavity 9, so only one detection signal S2 is generated. On the other hand, if the molten metal has turbulent flow, it will contact the second detection member 69A more than once. The second detection member 69A generates a detection signal S2 each time it contacts the molten metal. The number of detections are stored in the counter circuit 202 as a count value. Then, in step S16, comparison is made between the count value stored in the counter circuit 202 and the preset value stored in the setting circuit 302.

In step S16, if the count value is not less than the preset value (S16: Yes), a routine goes into step S17 where an alarm is generated by the alarm unit 500, and subsequent casting operation will be continued. The alarm warns the operator that the injection has turbulent flow. Thus, a casting finish switch (not shown) is manipulated to stop the casting operation, and degree to which the valve of the hydraulic circuit 600 is open is adjusted. On the other hand, if the count value is less than the preset value (S16: No), the casting operation is continued. Incidentally, the advancing movement of the injection plunger 15 may push the molten metal beyond the cavity 9 and into the gas vent passage 29. When the molten metal is brought into contact with the first detection member 69, the first detection member 69 outputs the molten metal detection signal S1 to the control circuit 103, so that the latter 103 outputs a change-over signal S7 to the electromagnetic change-over valve 57. Thus, the valve 57 is moved to the change-over position **57*b*. By this change-over operation, the compressed air in the compressor 55 is supplied to the front chamber 63 of the cylinder 51, so that the piston 53 is retracted rightwardly in the drawing. If the piston 53 is moved to its predetermined retracted position, the valve body 47 is seated onto the valve seat 67 to close the gas vent valve 43. Accordingly, the gas vent passage 29 is shut-off to prevent the molten metal from leaking downstream of the gas vent valve 43**.

Next, in step S18, judgment is made as to whether or not a predetermined time period has passed. The predetermined time period is the time period predetermined in the initial setting step S12 as required for the molten metal to fill the cavity 9 and the gas vent passage 29. If the predetermined time period has elapsed (S18: Yes), in step S19 the metal mold is opened for removing the casted product therefrom, and the injection plunger 15 is moved to its retracted position. Then, in step S20, judgment is made as to whether or not the casting stop switch (not shown) is manipulated. If the casting stop switch is not manipulated (S20: No), the routine goes back to step S13 for a subsequent casting, and the counter circuit 200 is subjected to resetting. On the other hand, if the casting stop switch is manipulated (S20: Yes), the casting operation is stopped. Incidentally, as is apparent from the flowchart shown in FIG. 2, casting is continued even if the alarm is generated in the step S17 after the steps S18 and S19 are executed. The casting stops in the step S20 when the casting stop switch is manipulated.

In the above described embodiment, various modification can be made. For example, in the above described embodiment the first and second detection members 69 and 69A are provided. However, the second detection member 69A can be dispensed with, and instead, the first detection member 69 connected to the control circuit 103 can also be connected to the filter circuit 201 for performing the relevant operation. Alternatively, the first detection member 69 can be dispensed with, and instead, the second detection member 69A can also be connected to the control circuit 103. Further, third and fourth detection members 69B and 69C can be provided within the cavity 9 and the runner portion 5, and the corresponding counter circuit 200 and the judgment circuit 300 can be added for precise judgment of the molten metal flow mode. Furthermore, a display unit can be connected to the counter circuit 202 so as to display the count value, whereby judgment of laminar flow or turbulent flow can be visually performed. Furthermore, in the above described embodiment, the downstream side of the gas vent valve is open to the atmosphere. However, a vacuum suction unit such as disclosed in Japanese Utility Model Publication No. Hei 2-4430 can be connected to the downstream side for positively discharging gas within the cavity 9 out of the metal mold.

As described above, according to the laminar flow injection molding apparatus and the laminar flow injection molding method of the present invention, since molten metal flow mode can be directly detected, accurate judgment as to laminar flow or turbulent flow can be performed. If the molten metal has laminar flow, the casting operation is continued, and if the molten metal has turbulent flow, valve opening degree of the hydraulic circuit can be easily re-adjusted. The judgment as to whether the flow is laminar or turbulent can be directly achieved during the casting process. Therefore, it is unnecessary to temporarily stop the casting operation to examine the casted product for determining whether the molten metal is injected with the laminar flow. Therefore, mass productivity can be maintained. Further, since it is easy to judge flow conditions, either laminar or turbulent flow, injecting conditions can be easily determined, which can enhance casting efficiency. Furthermore, even at the initial casting period at which the metal mold has a low temperature and it is difficult to obtain desired fluidity of the metal mold, it is possible to judge whether or not the casting is entered into a stabilizing phase on a basis of the judgment about flow described above.

While the invention has been described in detail and with reference to the specific embodiment thereof, it would be apparent to those skilled in the art that various changes and modifications may be made therein without departing from the spirit and scope of the invention.

What is claimed is:

1. A laminar flow injection molding method for use with a laminar flow injection molding apparatus comprising a casting sleeve, a pair of metal molds forming a runner portion in communication with the casting sleeve, a cavity and a gas vent passage, an injection plunger slidably disposed within the casting sleeve, an injection cylinder connected to the injection plunger for reciprocally moving the injection plunger, a cylinder drive means, a molten metal detection means for generating a molten metal detection signal each time a molten metal contacts the molten metal detection means in a single injection, a counting means connected to the molten metal detection means for counting the number of molten metal detection signals generated by the molten metal detection means, judging means connected to the counting means for storing a predetermined value and for comparing a count value of molten metal detecting signals with the predetermined value to determine whether turbulent flow is present, and control means connected to the counting means, judging means and the cylinder drive means for controlling a driving operation of the cylinder drive means based upon a result of the comparison by the judging means, said laminar flow injection molding method comprising the steps of:

disposing said molten metal detection means at least at one of the runner portion, the cavity and the gas vent passage;

inputting the predetermined value into the judging means, the predetermined value being indicative of a turbulent flow of the molten metal;

resetting the counting means in response to a start of an injection;

detecting the molten metal and generating a molten metal detection signal each time the molten metal contacts the molten metal detection means during a single injection;

storing a number of molten metal detection signals as the count value into the counting means; and comparing the count value with the predetermined value for a judgment of a flowing mode of the molten metal as turbulent flow when the count value is not less than the predetermined value.

2. A laminar flow injection molding method as claimed in claim 1, further comprising the steps of:

initiating an alarm when the molten metal has a turbulent flow determined as a result of the comparing step; and controlling the injection cylinder for changing a speed of the plunger when the molten metal has turbulent flow.

3. A laminar flow injection molding apparatus comprising:

a casting sleeve;

a pair of metal molds forming therein a runner portion in communication with the casting sleeve, a cavity and a gas vent passage;

an injection plunger slidably disposed within the casting sleeve for urging a molten metal into the cavity;

an injection cylinder connected to the injection plunger for reciprocally moving the injection plunger;

a cylinder drive means for driving the injection cylinder;

a molten metal detection means disposed at least in one of the runner portion, the cavity and the gas vent passage for generating a molten metal detection signal each time the molten metal contacts the molten metal detection means in a single injection;

a counting means electrically connected to the molten metal detection means for counting the number of molten metal detection signals output by said molten metal detection means as a count value and for storing the count value;

judging means electrically connected to the counting means for storing a predetermined value and for comparing the predetermined value with the count value; and control means electrically connected to the counting means, the judging means and the cylinder drive means for controlling a driving operation of the cylinder drive means when the count value is not less than the predetermined value and for resetting the counting means in response to a start of injection.

4. A laminar flow injection molding apparatus as claimed in claim 3, wherein the counting means comprises a counter circuit for counting the number of the molten metal detection signals output by the molten metal detection means.

5. A laminar flow injection molding apparatus as claimed in claim 4, wherein the counting means further comprises a filter circuit connected between the molten metal detection means and the counter circuit for filtering noise out of the molten metal detection signals which are supplied to the counter circuit via the filter circuit.

6. A laminar flow injection molding apparatus as claimed in claim 4, wherein the counter circuit is connected to the control means for receiving a count start signal from the control means to render the counter circuit operative and for receiving a counter reset signal from the control means to reset the count value in the counter circuit.

7. A laminar flow injection molding apparatus as claimed in claim 4, wherein the judging means comprises:

a comparison circuit connected to the counter circuit and the control means; and a setting circuit connected to the comparison circuit for provisionally setting a preset value deemed critical to turbulent flow, number of molten metal detection signals in the counter circuit and the predetermined value being compared in the comparison circuit.

8. A laminar flow injection molding apparatus as claimed in claim 6, wherein the judging means comprises:

a comparison circuit connected to the counter circuit and the control means; and a setting circuit connected to the comparison circuit for provisionally setting a preset value deemed critical to turbulent flow, numbers of molten metal detection signals in the counter circuit and the predetermined value being compared in the comparison circuit.

9. A laminar flow injection molding apparatus as claimed in claim 8, further comprising alarm means connected to the control means for alarming when the number of molten metal detection signals is not less than the predetermined value.

10. A laminar flow injection molding apparatus as claimed in claim 8, wherein the cylinder drive means comprises a hydraulic circuit connected between the control means and the injection cylinder for controlling the amount of hydraulic flow applied to the injection cylinder as a result of a comparison in the comparison circuit.

11. A laminar flow injection molding apparatus as claimed in claim 9, wherein the cylinder drive means comprises a hydraulic circuit connected between the control means and the injection cylinder for controlling the amount of hydraulic flow applied to the injection cylinder as a result of a comparison in the comparison circuit.

12. A laminar flow injection molding apparatus as claimed in claim 11, further comprising:

a gas vent valve provided at the gas vent passage;

a valve driving mechanism connected to the gas vent valve for opening and closing the gas vent valve for selectively discharging gas in the cavity and the gas vent passage out of the metal molds; and a controller connected to the valve driving mechanism for controlling the valve driving mechanism.

13. A laminar flow injection molding apparatus as claimed in claim 12, further comprising a second molten metal detection means provided at the gas vent passage and connected to the controller for transmitting a second molten metal detection signal to the controller, the valve driving mechanism being operated in response to the second molten metal detection signal through the controller.

* * * * *